US008654013B2

(12) United States Patent
Watanabe et al.

(10) Patent No.: US 8,654,013 B2
(45) Date of Patent: Feb. 18, 2014

(54) MULTI-BAND ANTENNA

(75) Inventors: Munehisa Watanabe, Shiga-ken (JP); Kengo Onaka, Kanagawa-ken (JP); Takashi Ishihara, Tokyo-to (JP); Tsuyoshi Mukai, Kyoto-fu (JP); Yuichi Kushihi, Kanagawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 125 days.

(21) Appl. No.: 12/835,476

(22) Filed: Jul. 13, 2010

(65) Prior Publication Data

US 2011/0102268 A1 May 5, 2011

(30) Foreign Application Priority Data

Jul. 14, 2009 (JP) ..... 2009-165395

(51) Int. Cl.
*H01Q 1/38* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS

| | | | | |
|---|---|---|---|---|
| 6,597,259 | B1 * | 7/2003 | Peters | 333/134 |
| 7,196,667 | B2 | 3/2007 | Watada et al. | |
| 7,463,196 | B2 * | 12/2008 | Hilgers | 343/700 MS |
| 7,701,401 | B2 | 4/2010 | Suzuki et al. | |
| 7,714,795 | B2 * | 5/2010 | Wen et al. | 343/860 |
| 2006/0208950 | A1 * | 9/2006 | Tago | 343/702 |
| 2006/0290575 | A1 * | 12/2006 | Pelzer | 343/702 |

FOREIGN PATENT DOCUMENTS

| | | | |
|---|---|---|---|
| JP | 09-153734 | | 6/1997 |
| JP | 2006-067259 | A | 3/2006 |
| JP | 2007-524310 | T | 8/2007 |
| JP | 2008-126724 | A1 | 10/2008 |
| JP | 2009-033742 | A | 2/2009 |
| WO | 2005/083535 | A2 | 9/2005 |

OTHER PUBLICATIONS

Japanese Office Action "Notification of Reason for Rejection" dated Aug. 23, 2011; Japanese Patent Application No. 2009-165395 with translation.

(Continued)

*Primary Examiner* — Douglas W Owens
*Assistant Examiner* — Jae Kim
(74) *Attorney, Agent, or Firm* — Studebaker & Brackett PC

(57) ABSTRACT

An antenna includes a base, a first radiating element, and second radiating element. The first radiating element is open at a first end thereof, is connected to a ground point at a second end thereof, and resonates in a substantially ¼ wavelength mode in a first communication frequency band. A feed line is connected between a first feed point and a predetermined position between the first end and the second end of the first radiating element. The second radiating element has a first end that is a second feed point, a second end that is connected to the ground point, and resonates in a substantially ½ wavelength mode in a second communication frequency band. A distance from the ground point to the second feed point is longer than a distance from the ground point to the first feed point.

6 Claims, 6 Drawing Sheets

(56) References Cited

OTHER PUBLICATIONS

Kyouhei Fujimoto et al.; Graphic Explanation of Mobile Communication Antenna System; Oct. 10, 1996; pp. 113-114; published by Sougou Denshi Publishing Co., Ltd. Tokyo, Japan; with English translation.

The first Office Action issued by State Intellectual Property Office of People's Republic of China dated Oct. 10, 2012, which corresponds to Chinese Patent Application No. 201010228916.4 and is related to U.S. Appl. No. 12/835,476, with translation.

The Second Office Action issued by the State Intellectual Property Office of People's Republic of China on Mar. 4, 2013, which corresponds to Chinese Patent Application No. 201010228916.4 and is related to U.S. Appl. No. 12/835,476 with English translation.

* cited by examiner

MULTI-BAND ANTENNA

CROSS REFERENCE TO RELATED APPLICATIONS

The present application claims priority to Japanese Patent Application No. 2009-165395 filed Jul. 14, 2009, the entire contents of this application being incorporated herein by reference in their entirety.

FIELD OF THE INVENTION

The present invention relates to a multi-band antenna having at least two radiating elements on a base for example, an antenna that is provided in a housing of a mobile radio communication terminal.

BACKGROUND

Antennas for use in a mobile radio communication terminal such as a cellular phone terminal are disclosed in Japanese Unexamined Patent Application Publication No. 2009-33742 (Patent Document 1), Japanese Unexamined Patent Application Publication (Translation of PCT Application) No. 2007-524310 (Patent Document 2), Japanese Unexamined Patent Application Publication No. 2006-67259 (Patent Document 3), and Japanese Unexamined Patent Application Publication No. H9-153734 (Patent Document 4).

The antenna in Patent Document 1 is a dual-feed multi-band antenna. FIG. 1 shows a configuration of an antenna device in Patent Document 1. A first antenna element 11 is fed at a first feed point 13 provided on a substrate 1, and is grounded so as to be short-circuited to a ground circuit of the substrate 1 at a first short-circuit portion 14. A second antenna element 12 is fed at a second feed point 15 provided on the substrate 1, and is grounded so as to be short-circuited to the ground circuit of the substrate 1 at a second short-circuit point 16. The first short-circuit point 14 and the second short-circuit point 16 are provided between the first feed point 13 and the second feed point 15.

The first antenna element (radiating element) 11 operates in a substantially λ/4 mode, and the second antenna element (radiating element) 12 operates in a substantially λ/2 mode. The radiating element of the substantially λ/2 mode has a folded shape and its ground point is located near its feed point.

The antennas in Patent Documents 2 and 3 are dual-feed multi-band antennas in which two radiating elements have a common ground point. The feeding manner for the both antennas is capacitance feeding.

The antenna in Patent Document 4 is a single-feed single-band antenna in which a ground point is located near a feed point. The feeding manner for the antenna is direct feeding.

Patent Document 1 describes that isolation is improved by locating the ground points of the two radiating elements between the feed points of the two radiating elements. However, when the antenna device is installed (mounted) on a circuit board, the total number of terminal electrodes is four (the two feed points and the two ground points), which leads to an increase of cost and a decrease of reliability. Further, Patent Document 1 does not describe antenna efficiency. However, in general, if an electrode pattern of a substantially λ/4 mode is formed so as to have a folded structure and a ground point is located near a feed point, the loop diameter becomes small, and the radiation resistance becomes low, resulting in deterioration of the antenna efficiency.

In Patent Documents 2 and 3, two radiating elements seem to operate in a substantially λ/4 mode due to the structure. Further, there is no description concerning an operation in a substantially λ/2 mode, and the effect caused by a combination with a substantially λ/2 mode is not described.

Further, if, in the structures of the antennas disclosed in Patent Documents 2 and 3, the feeding manner is changed into direct feeding as in Patent Document 4, it will be expected that sufficient isolation cannot be ensured between the two radiating elements.

SUMMARY

The invention provides an antenna that has high antenna efficiency and a high isolation between two radiating elements.

In an embodiment consistent with the claimed invention, an antenna comprises a first radiating element and a second radiating element on a base. The first radiating element is open at a first end thereof, is connected to a ground point at a second end thereof, and resonates in a substantially ¼ wavelength mode in a first communication frequency band. A feed line that connects between a first feed point and a predetermined position between the first end and the second end of the first radiating element is provided. The second radiating element has a first end that is a second feed point, has a second end that is connected to the ground point, and resonates in a substantially ½ wavelength mode in a second communication frequency band. A distance from the ground point to the second feed point is longer than a distance from the ground point to the first feed point.

According to a more specific exemplary embodiment, a resonant frequency f1 of the first radiating element and a resonant frequency f2 of the second radiating element may satisfy the following relation:

$$0.37<f1/f2<0.96.$$

Other features, elements, characteristics and advantages of the invention will become more apparent from the following detailed description of preferred embodiments (with reference to the attached drawings).

DETAILED DESCRIPTION

Figure 1:
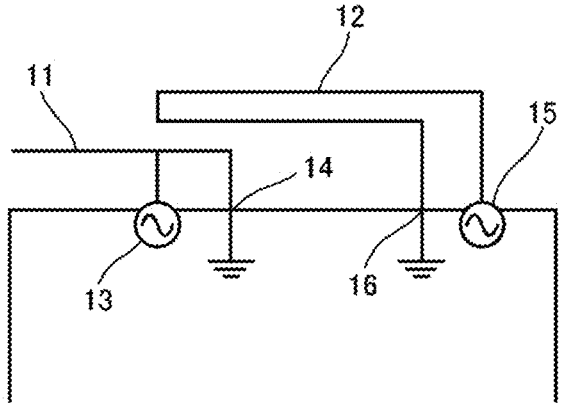
FIG. 1 Prior Art
FIG. 1 shows a configuration of an antenna device in Patent Document 1.
Figure 2A:
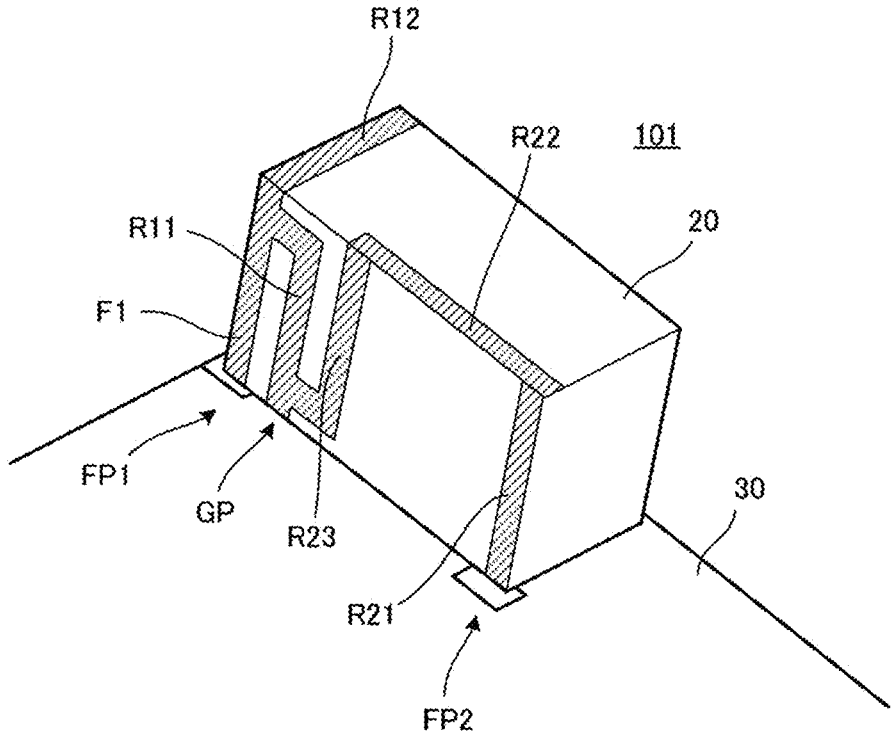
FIG. 2A is a perspective view of an antenna according to an exemplary embodiment.
Figure 2B:
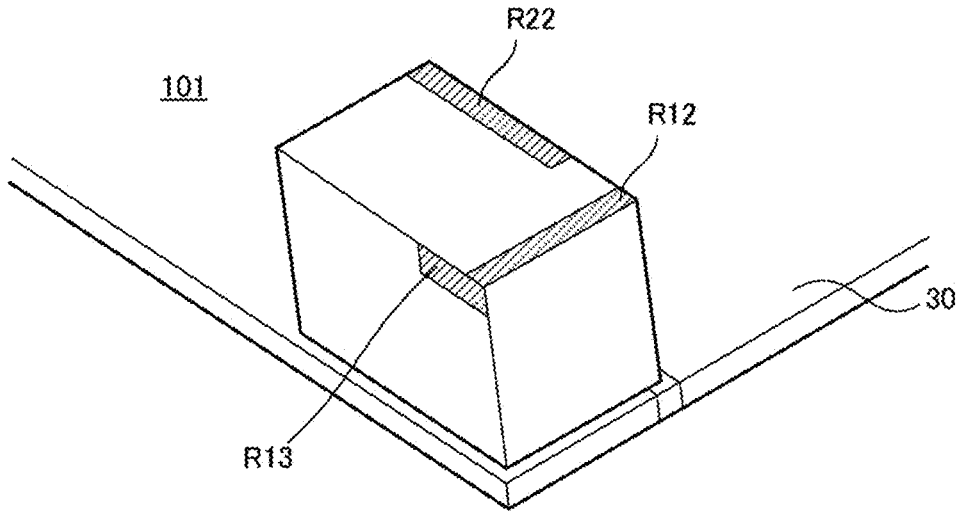
FIG. 2B is another perspective view of the antenna shown in FIG. 2A.

An antenna 101 according to an exemplary embodiment will be described with reference to FIGS. 2A to 6. FIGS. 2A and 2B are perspective views of the antenna 101. FIG. 2A is a perspective view when a corner portion of a circuit board 30 on which the antenna 101 is mounted is seen diagonally from the front of the circuit board 30. FIG. 2B is a perspective view when the corner portion of the circuit board 30 is seen diagonally from the rear of the circuit board 30.

The antenna 101 includes a dielectric base (dielectric block) 20 having a substantially rectangular parallelepiped shape, and a conductor having a predetermined pattern that is formed on an outer surface of the dielectric base 20. A first power supply terminal electrode FP1, a second power supply terminal electrode FP2, and a ground terminal electrode GP are formed on a lower surface (a mounted surface with respect to the circuit board 30) of the dielectric base 20. The first power supply terminal electrode FP1, the second power supply terminal electrode FP2, and the ground terminal electrode GP corresponds to "a first feed point", "a second feed point", and "a ground point", respectively.

On a front surface of the dielectric base 20, a conductor pattern R11 is formed so as to extend from the ground terminal electrode GP. On an upper surface of the dielectric base 20, a conductor pattern R12 is formed so as to extend from the conductor pattern R11. On a rear surface of the dielectric base 20, a conductor pattern R13 is formed so as to extend from the conductor pattern R12. These conductor patterns R11, R12, and R13 constitute a first radiating element.

On the front surface of the dielectric base 20, a feed line F1 is formed so as to extend from the first power supply terminal electrode FP1 to a part of the conductor pattern R11.

On the front surface of the dielectric base 20, a conductor pattern R21 is formed so as to extend from the second power supply terminal electrode FP2. On the upper surface of the dielectric base 20, a conductor pattern R22 is formed so as to extend from the conductor pattern R21. On the front surface of the dielectric base 20, a conductor pattern R23 is formed so as to extend from the conductor pattern R22 to the ground terminal electrode GP. These conductor patterns R21, R22, and R23 constitute a second radiating element. The antenna 101 is mounted on an upper surface of a ground electrode forming region of the circuit board 30.

Figure 3A:
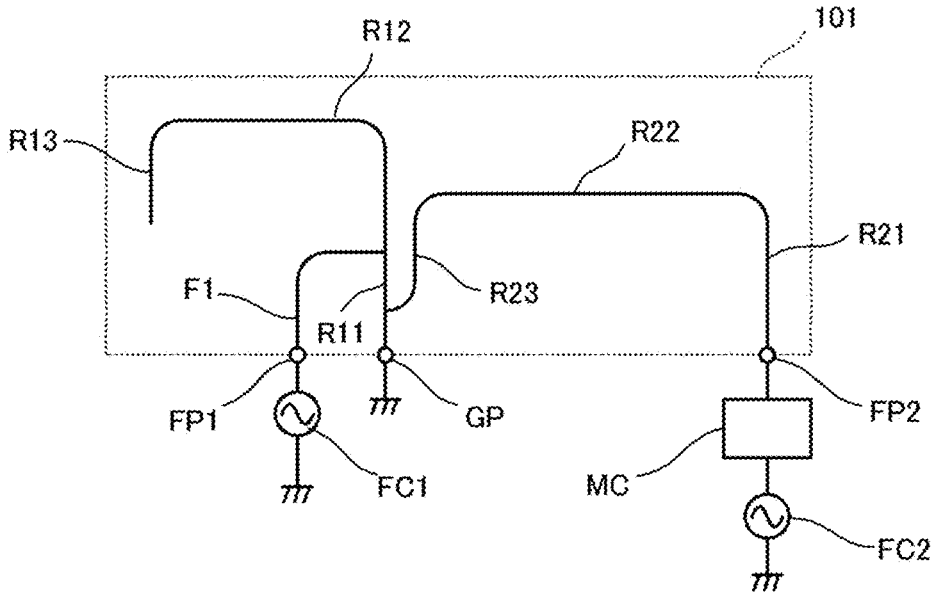
FIG. 3A is an equivalent circuit diagram of the antenna shown in FIGS. 2A and 2B.
Figure 3B:
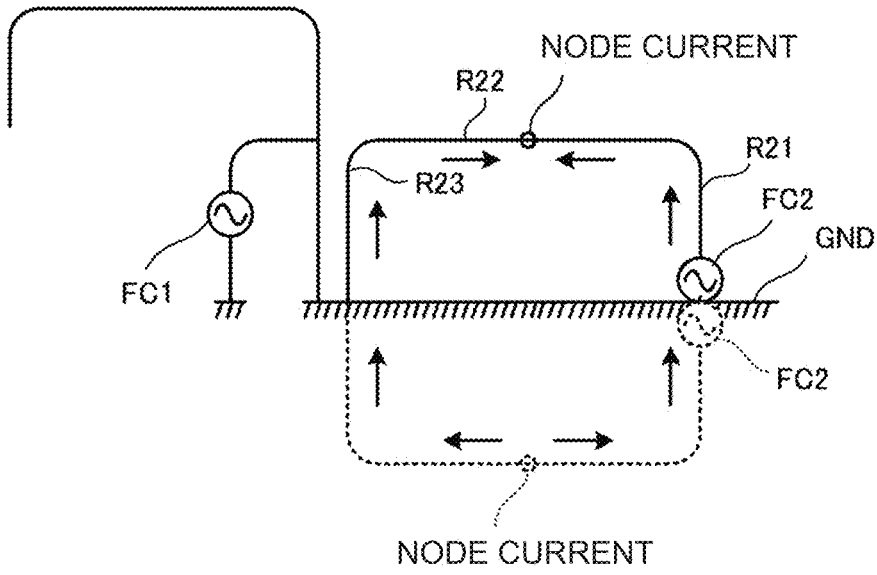
FIG. 3B is an equivalent circuit diagram of the antenna shown in FIGS. 2A and 2B.

FIGS. 3A and 3B are equivalent circuit diagrams of the antenna 101. In FIG. 3A, each reference character corresponds to each reference character shown in FIGS. 2A and 2B. A first power supply circuit FC1 is connected to the first power supply terminal electrode FP1 and handles a first communication frequency band. A second power supply circuit FC2 is connected to the second power supply terminal electrode FP2 and handles a second communication frequency band. A ground of the circuit board 30 is connected to the ground terminal electrode GP.

A voltage supplied from the first power supply circuit FC1 is applied to a predetermined position of the first radiating element via the feed line F1.

The first radiating element constituted of the conductor patterns R11, R12, and R13 is open at a first end thereof and grounded at a second end thereof. Due to this structure, the first radiating element resonates in a substantially ¼ wavelength mode in the first communication frequency band.

Further, a first end of the second radiating element constituted of the conductor patterns R21, R22, and R23 is connected to a matching circuit MC and the second power supply circuit FC2 via the second power supply terminal electrode FP2. A second end of the second radiating element is grounded via the ground terminal electrode GP. Thus, the second radiating element resonates in a substantially ½ wavelength mode in the second communication frequency band. The matching circuit MC matches the impedance between the second power supply circuit FC2 and the second radiating element constituted of the conductor patterns R21, R22, and R23.

According to the structure described above, the ground terminal electrode GP is shared by the first and second radiating elements, and thus the number of terminal electrodes can be reduced. Therefore, the cost can be reduced, and improvement of reliability such as corrosion resistance can be also expected.

FIG. 3B is another equivalent circuit diagram of the antenna 101. In FIG. 3B, the reference character GND denotes a ground electrode on a circuit board. The second radiating element constituted of the conductor patterns R21, R22, and R23 is disposed, or provided on the ground electrode on the circuit board, and thus, as indicated by the broken line in FIG. 3B, a ground plane image occurs with the ground electrode GND of the circuit board 30 as a mirror surface. The arrows in the drawing indicate the direction of a current at a half cycle.

Due to the ground plane image occurring with the ground electrode GND of the circuit board 30 as a mirror surface as described above, the second radiating element acts as a single-frequency radiating element with a large loop area. The second radiating element constituted of the conductor patterns R21, R22, and R23 does not have a folded structure. The first and second radiating elements are formed such that the distance from the ground terminal electrode GP to the second power supply terminal electrode FP2 is longer than the distance from the ground terminal electrode GP to the first power supply terminal electrode FP1. Thus, even when the dielectric base 20 with a limited size is used, the second radiating element with a large loop area can be formed. Therefore, the radiation resistance of the second radiating element becomes great and high antenna efficiency is obtained.

In general, in a loop antenna that operates in a substantially $\lambda/2$ mode, the radiation resistance Rr increases as the loop area increases as shown in the following formula. Here, where: the shape of a radiating element is a substantially circular loop; the outer diameter of the loop is R; a conductor width is r; and a current flowing through the loop is I, a magnetic moment m is represented by:

$$m=I\pi R^2.$$

Where: the characteristic impedance of the space is denoted by Zo ($120\pi$ [Π]); a wave number is denoted by ko ($ko=2\pi/\lambda$ [rad/m]); a wavelength is denoted by $\lambda$, the radiation resistance Rr satisfies the following relation.

$$Rr=(Zoko^4/6\pi)(m/2I)^2$$

$$=(Zoko^4/24)\pi R^4$$

Therefore, the second radiating element does not have a folded structure, and the radiation resistance of the second radiating element increases as the loop area is increased by the position of the ground point being distant from the feed point. As a result, high antenna efficiency is obtained.

Figure 4A:
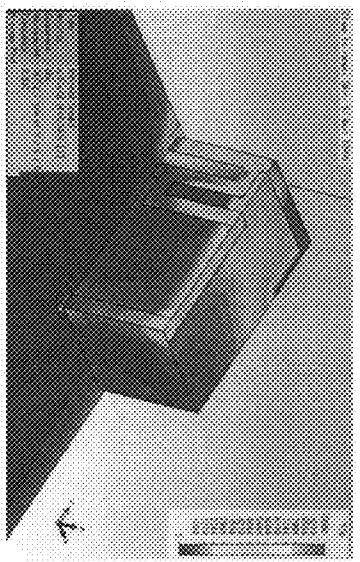
FIG. 4A is an electric field intensity distribution view when a first radiating element of the antenna of FIGS. 2A and 2B resonates.
Figure 4B:
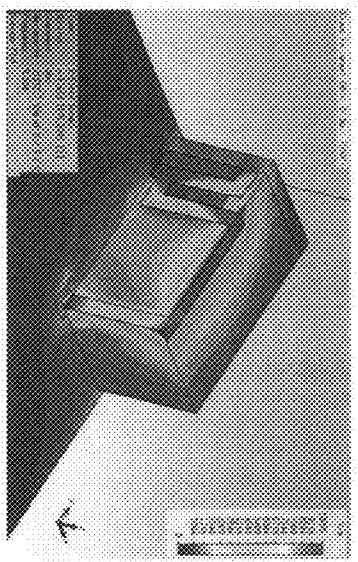
FIG. 4B is an electric field intensity distribution view when a second radiating element of the antenna of FIGS. 2A and 2B resonates.
Figure 4C:
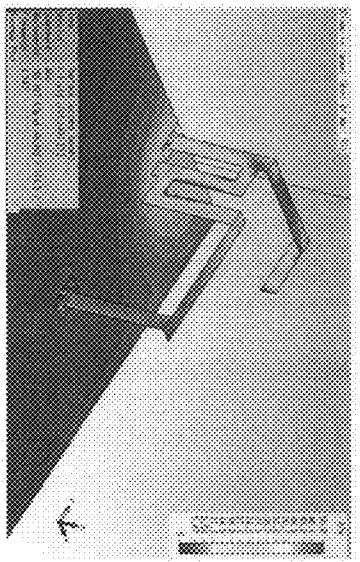
FIG. 4C is a current intensity distribution view when the first radiating element of the antenna of FIGS. 2A and 2B resonates.
Figure 4D:
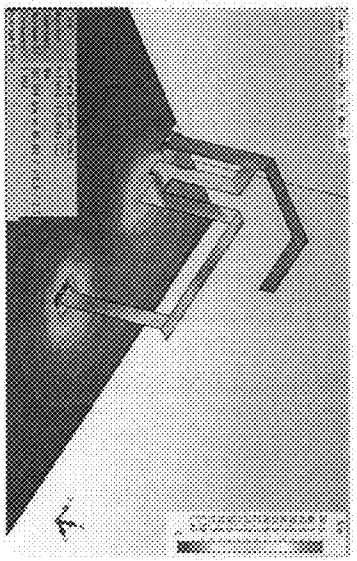
FIG. 4D is a current intensity distribution view when the second radiating element of the antenna of FIGS. 2A and 2B resonates.

FIG. 4A is an electric field intensity distribution view when the first radiating element of the antenna 101 resonates, and FIG. 4B is an electric field intensity distribution view when the second radiating element of the antenna 101 resonates. FIG. 4C is a current intensity distribution view when the first radiating element of the antenna 101 resonates, and FIG. 4D is a current intensity distribution view when the second radiating element of the antenna 101 resonates. Each of these views is a perspective view as seen in the same direction as FIG. 2A.

Here, the center frequency f1 of the first communication frequency band is set at 3600 MHz, the center frequency f2 of the second communication frequency band is set at 5500 MHz (f1/f2=0.65), and these distribution views are obtained by an electromagnetic field simulation.

As shown in FIGS. 4A and 4C, when the first radiating element resonates, the intensity of the electromagnetic field on the second radiating element is low. In other words, the second radiating element is less likely to be excited.

Similarly, as shown in FIGS. 4B and 4D, when the second radiating element resonates, the intensity of the electromagnetic field on the first radiating element is low. In other words, the first radiating element is less likely to be excited. According to this, it can be seen that the isolation between the first radiating element and the second radiating element is high.

In the case where the center frequency f1 of the first communication frequency band and the center frequency f2 of the second communication frequency band satisfy the following relation:

$$0.37<f1/f2<0.96,$$

when the second radiating element resonates, for example, at 5 GHz, the first radiating element becomes an end-open line whose frequency is about from ¼ to ¾ of the frequency f2.

In the end-open radiating element, a connection point opposed to the open end has a high impedance with respect to about ½ wavelength. Thus, with the relation between the center frequency f1 of the first communication frequency band and the center frequency f2 of the second communication frequency band in the above range, the first radiating element becomes less likely to be excited at the frequency f2.

Further, when the first radiating element resonates at 2.5 GHz, the second radiating element becomes a both-ends short-circuited line whose frequency is equal to or lower than about ½ of the frequency f1.

In the ends short-circuited radiating element, a connection point opposed to the short-circuited end has a high impedance with respect to about ¼ wavelength. Thus, with the relation between the center frequency f1 of the first communication frequency band and the center frequency f2 of the second communication frequency band in the above range, the second radiating element becomes less likely to be excited at the frequency f1.

Therefore, with the relation between the center frequency f1 of the first communication frequency band and the center frequency f2 of the second communication frequency band in the above range, the isolation between the first radiating element and the second radiating element can be increased.

Figure 5:
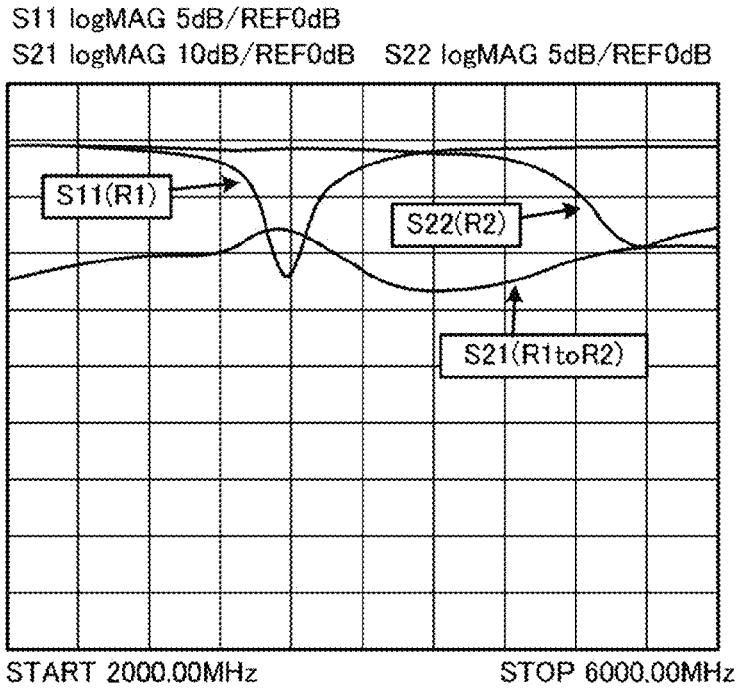
FIG. 5 shows an actual measurement result of an isolation characteristic.

FIG. 5 shows an actual measurement result of the isolation characteristic. In FIG. 5, a curve S11 (R1) indicates a return loss of the first radiating element; a curve S22 (R2) indicates a return loss of the second radiating element; and a curve S21 (R1 to R2) indicates a transmission amount between the first radiating element and the second radiating element.

The vertical axis for the curves S11 (R1) and S22 (R2) has a scale of 5 dB, and the vertical axis for the curve S21 (R1 to R2) has a scale of 10 dB. The horizontal axis indicates the frequency range of from 2 GHz to 6 GHz. As shown in the result, the isolation between the first radiating element and the second radiating element is ensured to be 15 dB or higher. This value is sufficient as a characteristic of a multi-band antenna.

Figure 6:
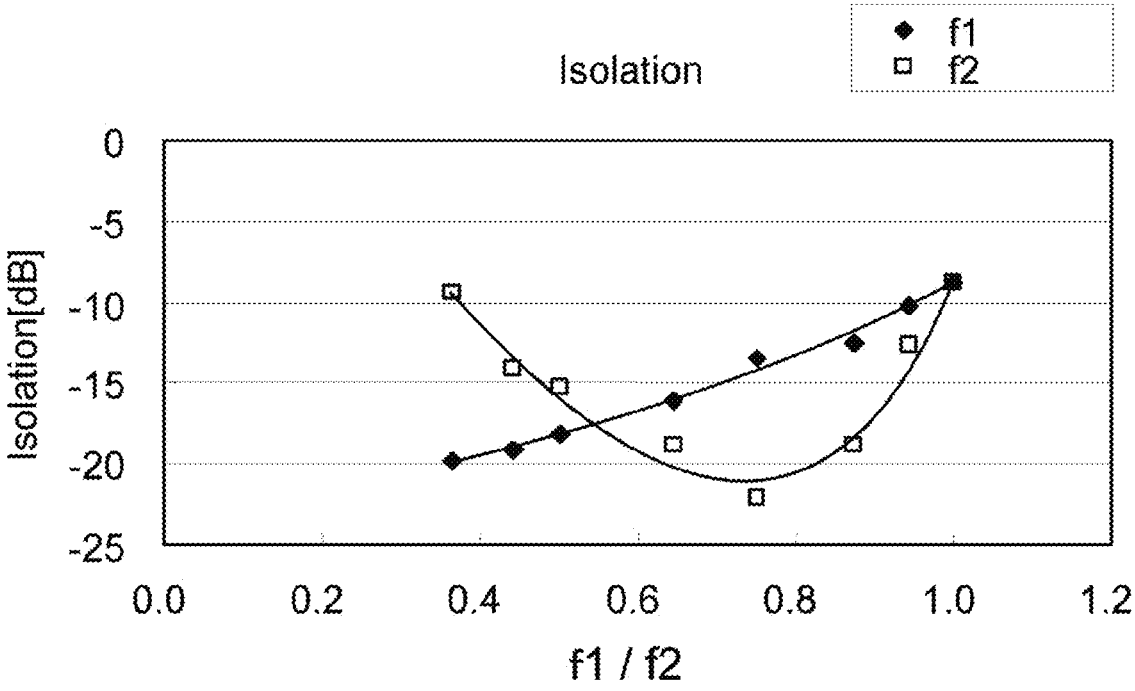
FIG. 6 shows an isolation characteristic with a changing ratio (f1/f2) of the center frequency f1 of a first communication frequency band and the center frequency f2 of a second communication frequency band.

FIG. 6 shows an isolation characteristic when the ratio (f1/f2) of the center frequency f1 and the center frequency f2 is changed. The rhomboids indicate isolation at the higher resonant frequency f1, and the squares indicate isolation at the lower resonant frequency f2.

In general, it is desirable to ensure an isolation of at least 10 dB or higher. From FIG. 6, when 0.37<f1/f2<0.96, it can be seen that an isolation of 10 dB or higher is ensured.

Figure 7A:
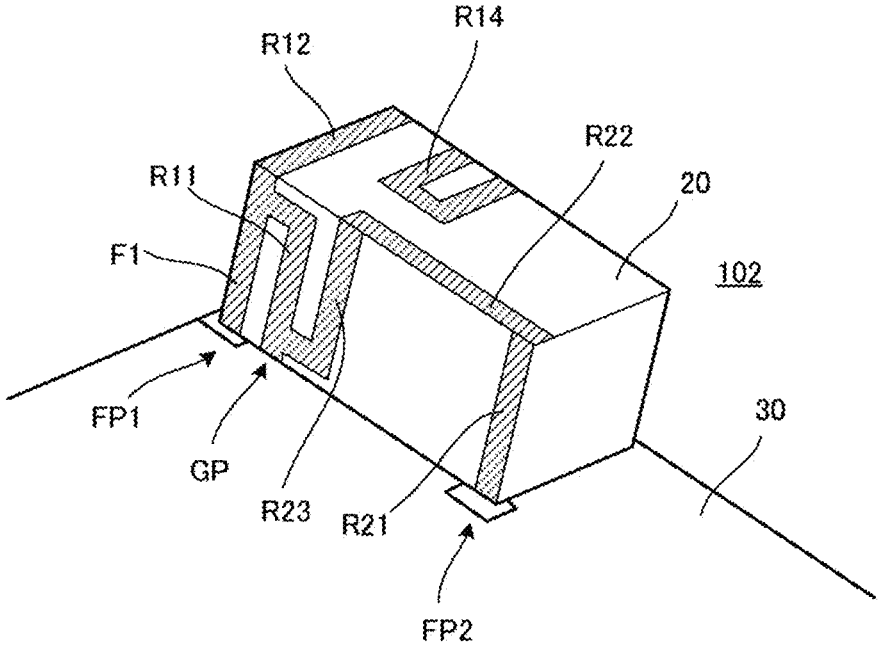
FIG. 7A is a perspective view of an antenna according to an exemplary embodiment.
Figure 7B:
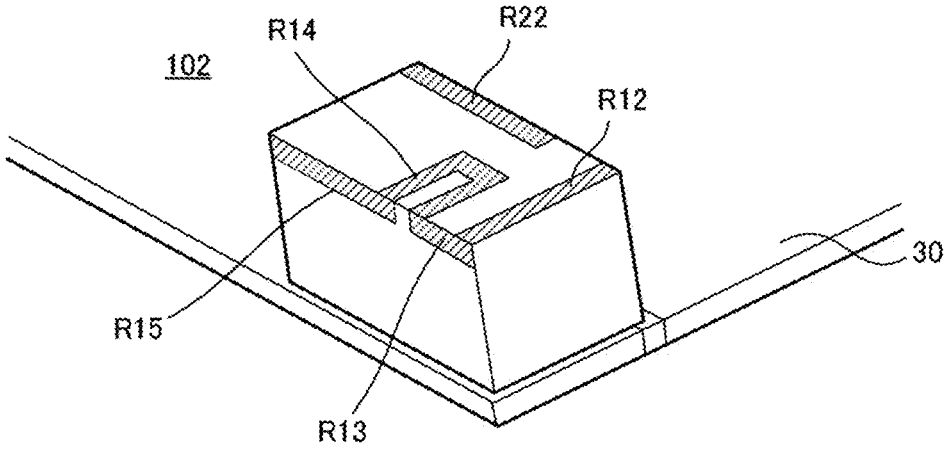
FIG. 7B is another perspective view of the antenna shown in FIG. 7A.

FIGS. 7A and 7B are perspective views of an antenna 102 according to another exemplary embodiment. FIG. 7A is a perspective view when a corner portion of a circuit board 30 on which the antenna 102 is mounted is seen diagonally from the front of the circuit board 30. FIG. 7B is a perspective view when the corner portion of the circuit board 30 is seen diagonally from the rear of the circuit board 30.

The antenna 102 includes a dielectric base (dielectric block) 20 having a substantially rectangular parallelepiped shape, and a conductor having a predetermined pattern is formed on an outer surface of the dielectric base 20. The antenna 102 is different from the exemplary embodiment of the antenna shown in FIGS. 2A and 2B in the conductor pattern for the first radiating element.

On a front surface of the dielectric base 20, a conductor pattern R11 is formed so as to extend from a ground terminal electrode GP. On an upper surface of the dielectric base 20, a conductor pattern R12 is formed so as to extend from the conductor pattern R11. On a rear surface of the dielectric base 20, a conductor pattern R13 is formed so as to extend from the conductor pattern R12. On the upper surface of the dielectric base 20, a substantially crank-shaped conductor pattern R14 is formed so as to extend from the conductor pattern R13. On the rear surface of the dielectric base 20, a conductor pattern R15 is formed so as to extend from the conductor pattern R14. These conductor patterns R11, R12, R13, R14, and R15 constitute a first radiating element. The other structure is the same as the antenna 101 shown in FIGS. 2A and 2B.

As described above, in the exemplary embodiment shown in FIGS. 7A and 7B, the conductor pattern R14 that extends in a substantially crank shape is provided in a part of the conductor pattern for the first radiating element. The crank-shaped conductor pattern is provided for causing the resonant frequency of the first radiating element to be a predetermined frequency.

Embodiments consistent with the claimed invention have a structure in the ground point shared by the first and second radiating elements. Thus, the number of terminal electrodes can be reduced, leading to a decrease in cost.

By using the second radiating element in a substantially λ/2 mode as an end short-circuited element and locating the ground point so as to be distant from the second feed point, the loop diameter can be increased and the radiation resistance can be increased. Thus, the antenna efficiency can be improved. Further, an isolation characteristic can be improved.

Additionally, the number of terminal electrodes to be conducted to electrodes on a circuit board on which the antenna is mounted is small, and thus the cost can be reduced.

While preferred embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. An antenna comprising:

a base;

a first radiating element on the base; and a second radiating element on the base, wherein the first radiating element is open at a first end thereof, is connected to a ground point at a second end thereof, and resonates in a substantially ¼ wavelength mode in a first communication frequency band, a feed line is connected between a first feed point and a predetermined position between the first end and the second end of the first radiating element, the second radiating element has a first end that is a second feed point, a second end that is connected to the ground point, and resonates in a substantially ½ wavelength mode in a second communication frequency band, a distance from the ground point to the second feed point is longer than a distance from the ground point to the first feed point;

the first feed point, the second feed point, and the ground point are positioned along an edge of the base, and the connection of the first radiating element to the ground point and the connection of the second radiating element to the ground point are positioned between the first and second feed points in an area on a side of the base adjacent to the edge.

2. The antenna according to claim 1, wherein a resonant frequency f1 of the first radiating element and a resonant frequency f2 of the second radiating element satisfy the following relation:

$$0.37<f1/f2<0.96.$$

3. The antenna according to claim 1, wherein the base is a dielectric material having a parallelepiped shape.

4. An antenna comprising:

a base of a dielectric material having a parallelepiped shape;

a first radiating element on the base; and a second radiating element on the base, wherein the first radiating element is open at a first end thereof, is connected to a ground point at a second end thereof, and resonates in a substantially ¼ wavelength mode in a first communication frequency band, a feed line is connected between a first feed point and a predetermined position between the first end and the second end of the first radiating element, the second radiating element has a first end that is a second feed point, a second end that is connected to the ground point, and resonates in a substantially ½ wavelength mode in a second communication frequency band, a distance from the ground point to the second feed point is longer than a distance from the ground point to the first feed point; and the connection of the first radiating element to the ground point and the connection of the second radiating element to the ground point are positioned between the first and second feed points, wherein the parallelepiped shaped base has a first side including a first power supply terminal electrode at the first feed point, a second power supply terminal electrode at the second feed point, and a ground terminal electrode at the ground point.

5. The antenna according to claim 4, wherein the first radiating element and the second radiating element each comprises conductor patterns provided substantially entirely on outer sides of the base not including the first side.

6. The antenna according to claim 1, wherein the first radiating element includes a conductor pattern having a portion extending outward from other portions of the conductor pattern for tuning the frequency at which the first radiating element resonates.

* * * * *